US005896720A

United States Patent [19]

Bond

[11] Patent Number: 5,896,720

[45] Date of Patent: Apr. 27, 1999

[54] SUPPORT CLIP BAR FOR A PITCHED ROOF

[76] Inventor: William R Bond, 4710 Asdee La., Woodbridge, Va. 22192

[21] Appl. No.: 08/912,301

[22] Filed: Aug. 8, 1997

[51] Int. Cl.[6] ..... E04C 5/12

[52] U.S. Cl. ..... 52/698; 248/74.1; 248/74.2; 24/336; 24/339; 24/462

[58] Field of Search ..... 248/74.1, 74.2; 24/336, 339, 462, 346

[56] References Cited

U.S. PATENT DOCUMENTS

| | | | |
|---|---|---|---|
| 1,241,922 | 10/1917 | Chappell | 24/339 |
| 1,711,730 | 5/1929 | Gibson . | |
| 2,797,886 | 7/1957 | Pinckney | 248/113 |

OTHER PUBLICATIONS

"Gripper Clips" Flyer by Gibson Good Tools, Inc. (2 Pages).

*Primary Examiner*—Carl D. Friedman
*Assistant Examiner*—Brian E. Glessner
*Attorney, Agent, or Firm*—Palmer C. DeMeo

[57] ABSTRACT

A clip bar for supporting, fixing or stabilizing air hoses, water hoses, electrical cords, safety ropes, cables, etc. on a shingled or unshingled, pitched roof of a building or house. The clip bar has a substantially flat element with a pair of spaced, U-shaped spring clips attached thereto. One or more of the clip bars can be secured to the roof by a nail or nails and support, fix or stabilize hoses, cords, ropes and/or cables thereto, thus, preventing these elements and any attachments thereto from sliding down and off the roof as well as preventing them from interfering with workers or roofers working on the pitched or inclined roof.

20 Claims, 4 Drawing Sheets

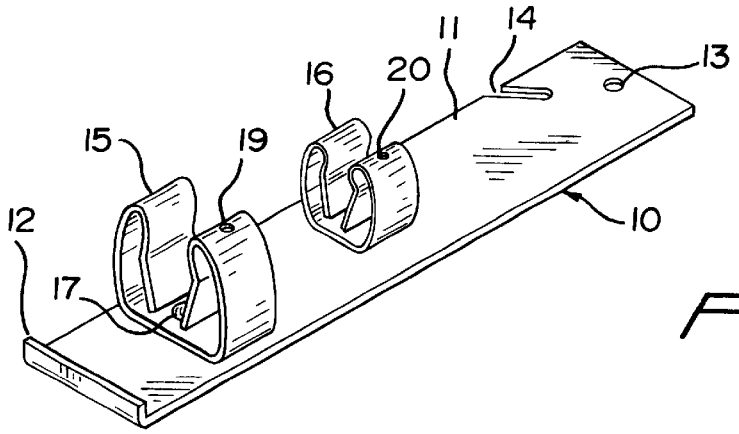
FIG. 1
FIG. 2
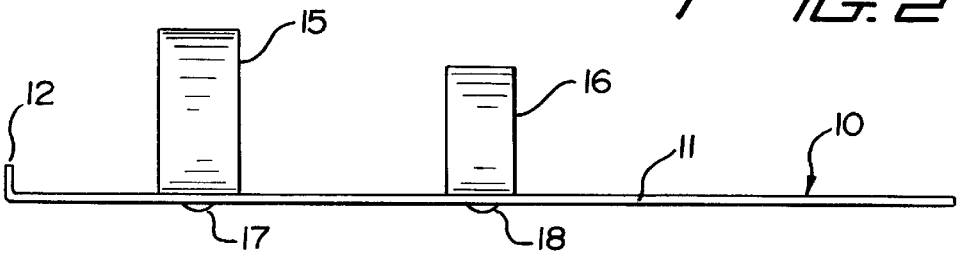
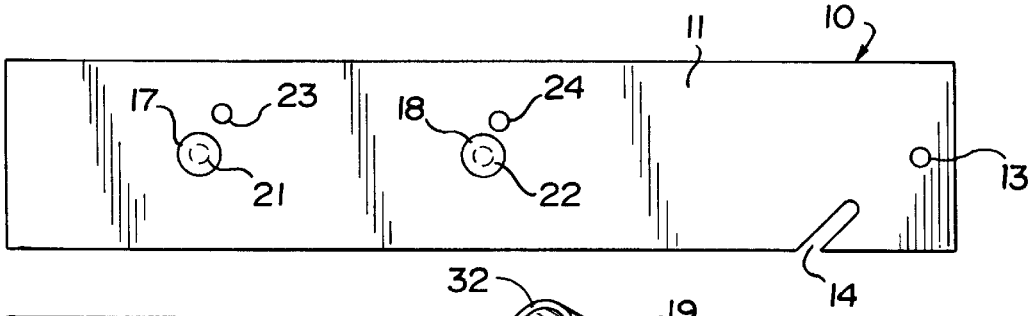
FIG. 3
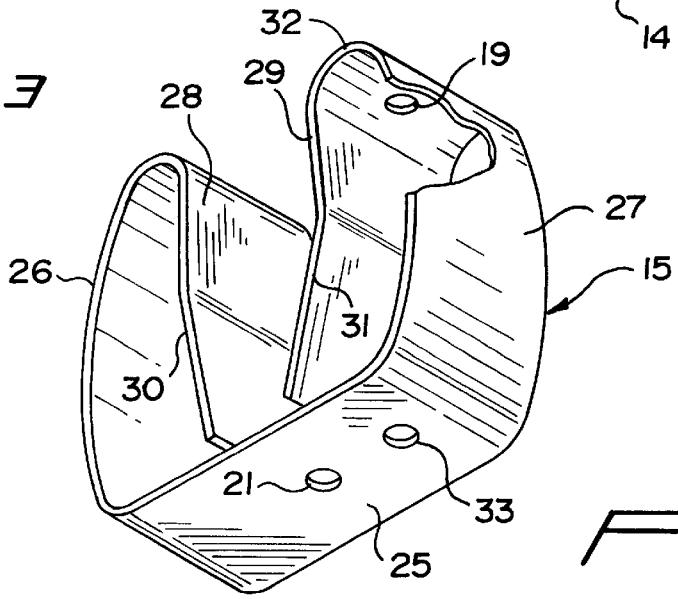
FIG. 4

SUPPORT CLIP BAR FOR A PITCHED ROOF

BACKGROUND OF THE INVENTION

1. Field of the Invention

The present invention relates generally to a clip bar for supporting, fixing or stabilizing air hoses, water hoses, electrical cords, safety ropes, cables, etc., on a shingled pitched roof. More particularly, the present invention concerns a clip bar having at least two U-shaped spring clips attached thereto. The clip bar is especially adapted to be temporarily secured to a shingled pitched roof in order to prevent air hoses, water hoses, electrical cords, safety ropes or cables from sliding down a pitched roof and to facilitate the use and handling of such air hoses, water hoses, electrical cords, safety ropes or cables by a roofer or worker while working on a shingled pitched roof of a house or building. The clip bar can also be used to temporarily support, fix or stabilize air hoses, water hoses, electrical cords, safety ropes, cables, etc., on an unshingled roof.

2. Description of the Related Art

Generally, a roofer or worker who uses an air hose, water hose, electrical cord, safety rope or cable for a particular application on a shingled pitched roof will hammer one or more appropriately sized nails into the roof sheathing, sometimes necessarily through the roof shingles, to temporarily support, fix or stabilize an air hose, water hose, electrical cord, safety rope, and/or cable to the roof of a building or house until the particular application has been completed after which the nails are removed. However, such a technique is awkward, cumbersome and time consuming to a roofer or worker and generally allows for the free movement of the air hose, water hose, electrical cord, safety rope, or cable in one direction or another such that slack in these elements can be a problem either to another roofer or worker working on the pitched or inclined roof or to the shrubbery next to the building or house at ground level. Also, holes left in the shingles after the nails are removed can cause water damage over the long run.

SUMMARY OF THE INVENTION

The present invention is directed to a clip bar having at least one spring clip, generally two, attached thereto. The spring clips (or clip) attached to the bar are generally of U-shaped configuration which clips can be of different sizes to support, fix or stabilize elements, e.g., air hose, water hose, electrical cord, safety rope or cable, having different size diameters to a shingled or unshingled, pitched or inclined roof. For example, a roofer or worker often uses a pneumatic hammer and an electrical skill saw to perform various constructional tasks on an inclined or pitched roof This situation would require an air (pressure) hose and an electrical cord to be on the pitched roof. In order to prevent these elements from sliding down the inclined roof and/or prevent any undesirable slack in these elements on the roof a clip bar of this invention is used. The clip bar, which has an aperture and an angled slot at one end thereof is secured to the roof by an appropriately sized nail either through the aperture or in the angled slot. The air hose is inserted into one of the spring clips of the clip bar and the electrical cord is inserted into another spring clip of the clip bar and each of the air hose and electrical cord may be pulled through their respective spring clip holder to take up any unwanted slack in them. Generally, the air hose has a larger outer diameter than the electrical cord, therefore, the air hose is inserted into the larger, appropriately sized, spring clip of the clip bar and the electrical cord is inserted into the smaller, appropriately sized, spring clip of the clip bar. Sometimes, it may be necessary to use two or more of the clip bars of this invention at appropriately spaced locations on the pitched roof in order to achieve the desired results.

The clip bar of this invention may be used on either an unshingled or a shingled pitched roof. If the inclined roof is unshingled, then the clip bar may be secured directly to the sheathing of the roof by an appropriately sized nail. If the inclined roof is shingled, then one end of the clip bar is secured, by an appropriately sized nail, to the sheathing of the roof beneath one of the already laid down and fastened shingles with the portion of the clip bar having the spring clips extending beyond the leading edge of the already laid down and fastened shingle. In the latter situation, the spring clips of the clip bar are exposed so that, for example, an air hose and an electrical cord can be secured respectively therein. Also, in the latter situation no holes are left exposed when the nail or nails for securing the clip bar or bars are removed after the tasks are completed. The clip bars of this invention are easily removed by the claws of a conventional hammer.

The flat portion of the clip bar of this invention may be made from hard plastic, hard rubber or metal but is preferably made from metal, for example, stainless steel. The U-shaped spring clips may also be made from hard plastic or hard rubber but is preferably made from metal such as spring steel. The U-shaped spring clips may be attached to the flat portion of the clip bar by any suitable means but is preferably attached thereto by rivets so that each spring clip is rotatable around a respective rivet.

Some other advantages of utilizing the clip bar of this invention on a pitched or inclined roof are: prevents hoses from pulling on the roofer or worker; eliminates tangles in the hoses, cords, ropes, or cables on the roof; prevents air tools from falling off of the roof; the clip bars are easily carried by the worker or roofer; the clip bars are reusable over and over again; and the clip bars can be easily installed and removed by a conventional hammer.

It is an object of this invention to facilitate the support, fixing or stabilizing of an air hose, water hose, electrical cord, safety rope or cable on a shingled or unshingled, pitched roof by utilizing one or more of the clip bars of this invention.

It is another object of this invention to provide a clip bar having one or more U-shaped spring clips attached thereto wherein the clip bar is especially adapted for use on a pitched or inclined roof of a house or building.

Other objects and advantages of the use of the clip bar of this invention will become apparent upon reading the following description, of which the attached drawings form a part.

BRIEF DESCRIPTION OF THE DRAWINGS

FIG. 1 is a perspective view of the support clip bar of this invention.

FIG. 2 is a side view of the support clip bar of this invention.

FIG. 3 is a bottom view of the support clip bar of this invention.

FIG. 4 is a perspective view of the larger spring clip secured to the support clip bar of this invention.

DESCRIPTION OF THE PREFERRED EMBODIMENTS

Figure 5:
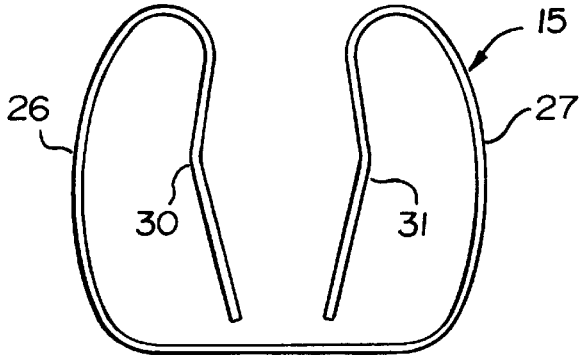
FIG. 5 is a side view of the larger spring clip secured to the support clip bar of this invention.

Referring now to FIGS. 1–3 of the drawing, there is shown a support clip bar 10 of this invention. The clip bar 10 has an elongated, substantially flat section 11 with a perpendicular raised portion 12 at one end thereof. The flat section 11 may be constructed from hard plastic or hard rubber but is preferably made from metal such as #26 gauge stainless steel. The overall length of the clip bar is approximately 7 and ½ inches long and 1 and ½ inches wide. Near one end of the flat section 11, there are an aperture 13 and a slot 14, either or both of which may be used for supporting the clip bar on an inclined roof For example, appropriately sized nails may be hammered through the aperture 13 and slot 14 into the sheathing of the roof. This method of securement is preferred for its stability since it prevents the clip bar 10 from moving and, thus, maintains the fixed securement of the elements, e.g., hoses, cords, ropes, cables, etc., by the clip bar 10. The diameter of the aperture 13 is approximately 3/16 inch and the slot 14 is approximately ½ inch long, ⅛ inch wide, and at a 45 degree angle with respect to the edge of the flat section 11. The clip bar 10 also has two spaced spring clips 15 and 16 secured thereto by means of rivets 17 and 18, respectively. The spring clips 15 and 16 may be of the same size or may be of different sizes to accommodate the holding of elements having different outer diameters, for example, a water hose and an electrical cord. The raised portion 12 of the flat section 11 is approximately ¼ inch. The flat section 11 also has two additional apertures 21 and 22 therein through which the rivets 17 and 18, respectively, pass to secure the spring clips 15 and 16, respectively, to the flat section 11. These additional apertures 21 and 22 in the flat section 11 are in alinement with each other and with aperture 13. Aperture 21 in the flat section 11 is approximately 1 and ½ inches from the raised portion 12, aperture 22 is approximately 2 inches from aperture 21, and aperture 13 is approximately 3 and ½ inches from aperture 22. Finally, the flat section 11 of the clip bar 10 has an aperture 23 therein adjacent but offset from aperture 21 and another aperture 24 adjacent but off-set from aperture 22. The distance from the center of aperture 21 to the center of aperture 23 is approximately ½ inch and the distance from the center of aperture 22 to the center of aperture 24 is approximately ¼ inch. The purpose of these apertures 23 and 24 will be explained later with reference to FIGS. 10 and 11. The purpose of aperture 19 in one arm of spring clip 15 and of aperture 20 in one arm of spring clip 16 will also be explained later with reference to FIGS. 10 and 11. The flat section 11 of the clip bar 10 may be cut from a sheet or strip of #26 gauge stainless steel with the raised portion 12 then bent by any conventional means, the apertures 21, 22, and 13 are then drilled or punched out, and, finally, the slot 14 cut out. Other conventional techniques may also be used to manufacture the flat section 11.

Figure 6:
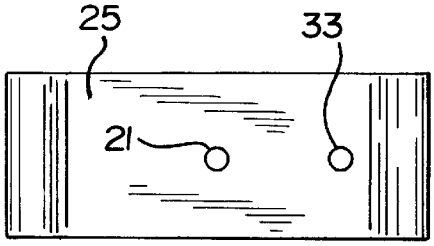
FIG. 6 is a bottom view of the larger spring clip secured to the support clip bar of this invention.

Referring now to FIGS. 4–6, there is shown a spring clip 15 which is preferably made from spring steel but may also be made from other metals or even from hard plastic or rubber materials. The spring clip 15 may also be constructed from a spring metal coated with vinyl but this would reduce the holding capacity of the clip. The spring clip 15 is formed from a strip or ribbon of spring steel with substantially a flat base 25 and a pair of curved arms extending therefrom and spaced opposite to each other. Each curved arm has an outwardly extending portion 26 or 27 and an inwardly extending portion 28 or 29. Each of the inwardly extending portions 28 and 29 has a gripping portion 30 and 31, respectively, near the center of the spring clip 15. The material and configuration of the spring clip 15 provide a degree of resiliency to enable the gripping portions 30 and 31 of the clip 15 to securely grip and maintain the hose, cord, rope or cable therebetween. In the bridge portion 32 between the curved portions 27 and 29 of one of the arms of the spring clip 15, there is an aperture 19 therein. In alignment therewith is another aperture 33 in the base 25 which aperture 33 is offset from the center aperture 21 in the base 25. The diameter of each aperture 21 and 33 is approximately 3/16 inch to accommodate either an 8-penny or 16-penny nail. The spring clip 15 itself may be of various sizes to accommodate the gripping of various sized air hoses, water hoses, electrical cords, safety ropes, or cables. Some of the more useful sizes are spring clips which have openings of 5/16 inch and ¾ inch. A spring clip with the former sized opening will securely hold hoses, cords, ropes, and cables having a diameter between ⅜ inch to ⅝ inch and the latter sized opening will securely hold hoses, cords, ropes, and cables having a diameter between ¾ inch to 1 and ⅛ inch. A spring clip having an arm to arm opening of 5/16 inch may, for example, have the following dimensions: 0.020 inch strip thickness, ½ inch strip width, 1 and ⅜ inch overall width from arm to arm, and 15/16 inch overall height. A spring clip having an arm to arm opening of ¾ inch may, for example, have the following dimensions: 0.032 inch strip thickness, ⅝ inch strip width, 1 and ⅝ inch overall width from arm to arm, and 1 and ¼ inch overall height. Each of the spring clips of this invention may be manufactured by techniques old and well known in the art. For example, a spring clip of this invention is formed from a strip or ribbon of spring steel and then bent into a U-shaped configuration (as shown in FIG. 4 and 5) by any conventional method old and well known in the art. Subsequently, the center aperture 21 may be drilled through the flat section 25 and the aligned pair of apertures 19 and 33 may be drilled through the U-shaped spring clip 15 in one operation. Other manufacturing techniques and/or sequences may also be used in providing the apertures in the spring clip 15. Although the details and manufacture of the larger spring clip 15 are given here, the details and manufacture of the smaller spring clip 16 shown in FIGS. 1 and 2 are similar except for the dimensions.

After the flat section 11 and the spring clips 15 and 16 are manufactured, the spring clips 15 and 16 and the flat section 11 are assembled together by the use of pop-rivets 17 and 18, respectively, through the apertures 21 and 22, respectively, in the flat section 11. The use of rivets for securing the spring clips 15 and 16 to the flat section 11 of the clip bar 10 allows the respective spring clips 15 and 16 to be rotatively movable which is desirable in some applications of the clip bar 10. Although the spring clips 15 and 16 of the clip bar 10 shown in FIGS. 1 and 2 are of different sizes, they may also be of the same size depending on the particular application.

Some practical examples of using the clip bar 10 of this invention are as follows.

Figure 7:
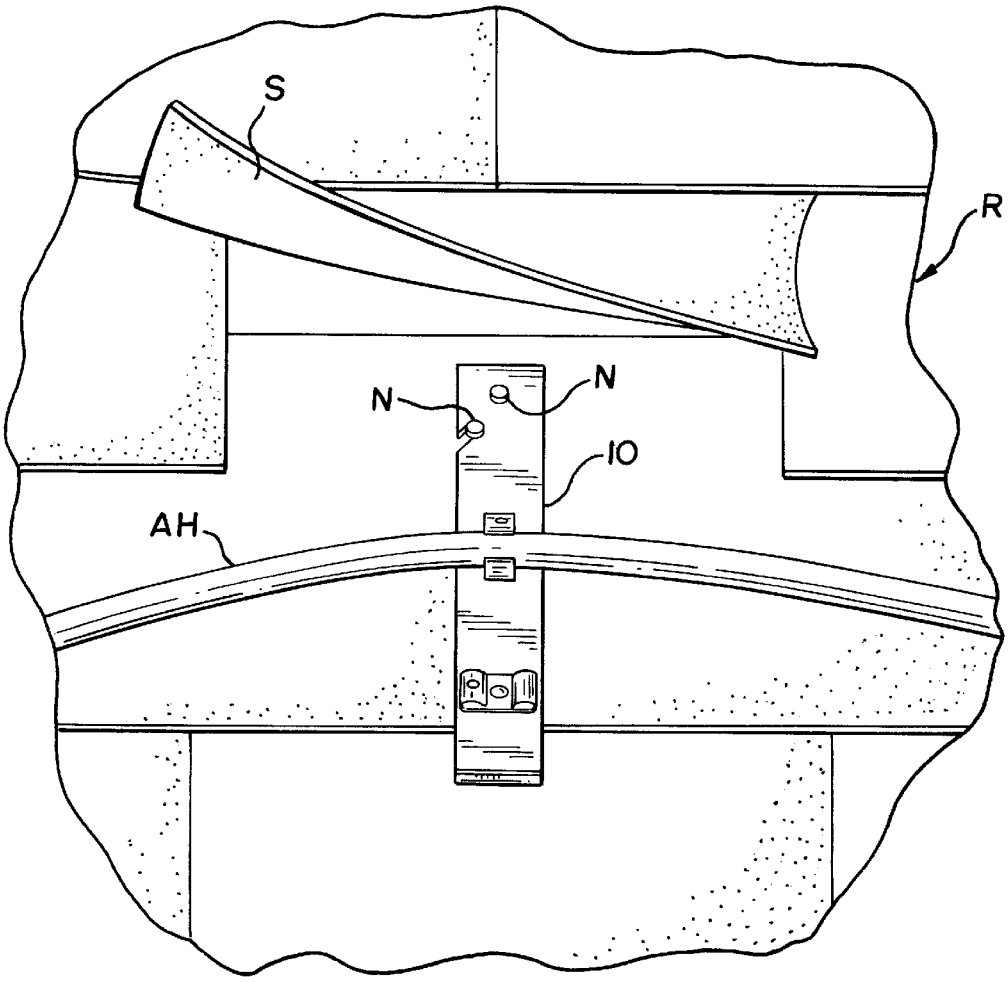
FIG. 7 shows an example of how the support clip bar of this invention is located and secured beneath a shingle of a shingled pitched roof.
Figure 8:
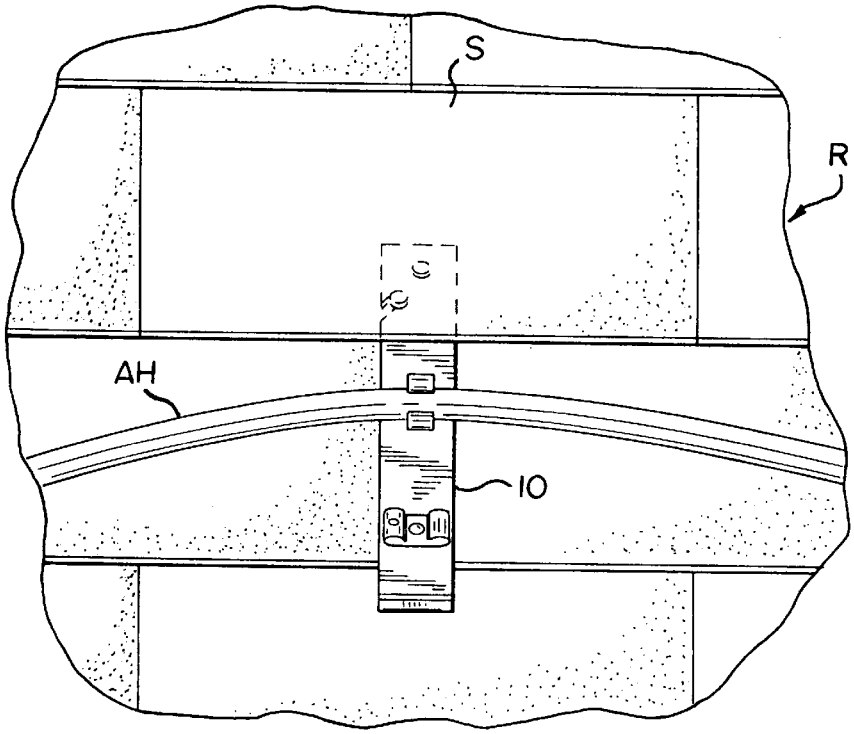
FIG. 8 shows another view of the example shown in FIG. 7.
Figure 9:
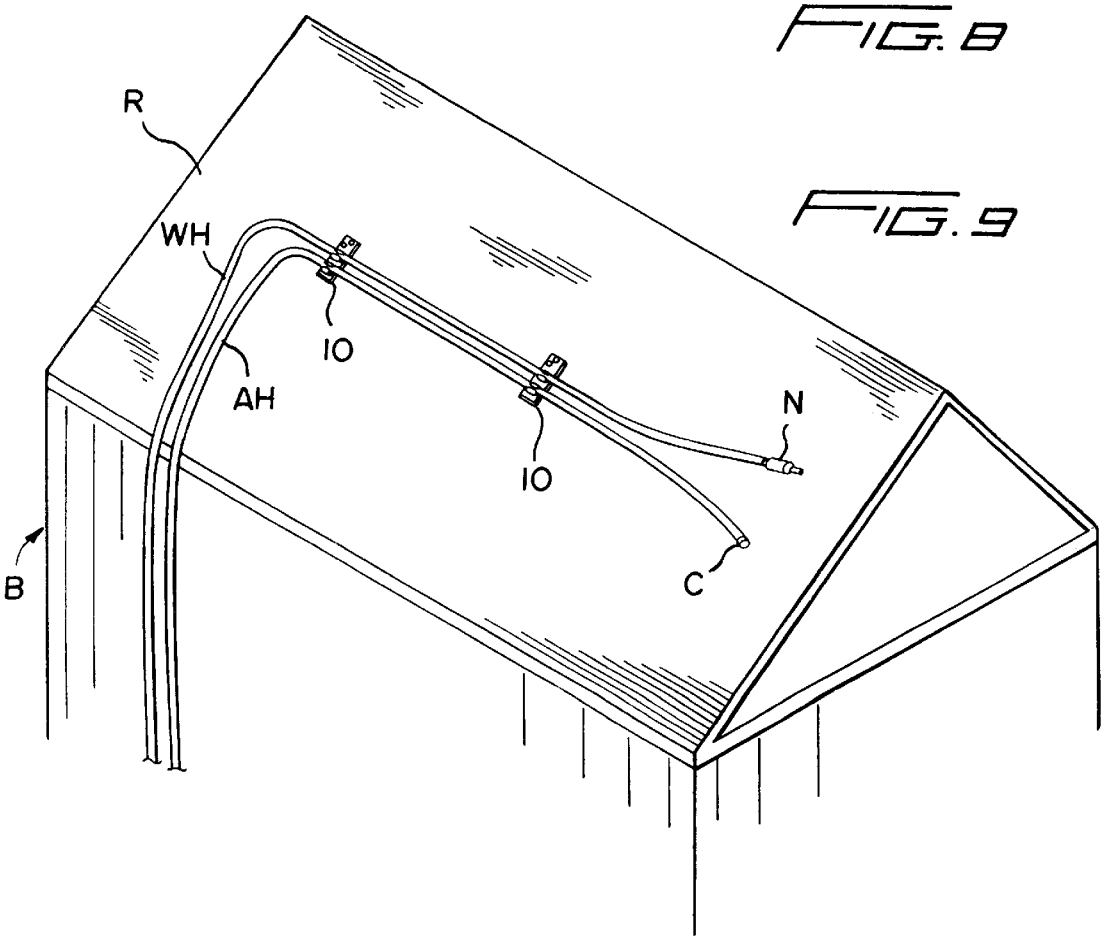
FIG. 9 shows an example of how two support clips of this invention are used on an unshingled pitched roof of a building.
Figure 10:
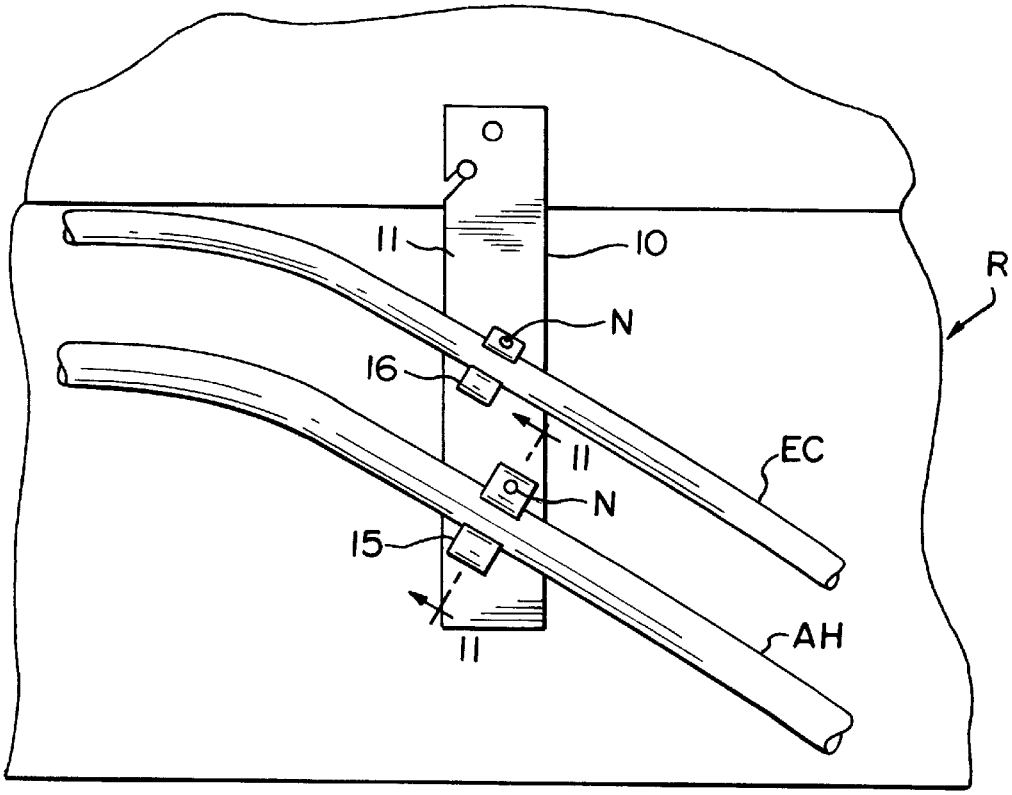
FIG. 10 shows another example of how a support clip of this invention is used on an unshingled pitched roof of a building.
Figure 11:
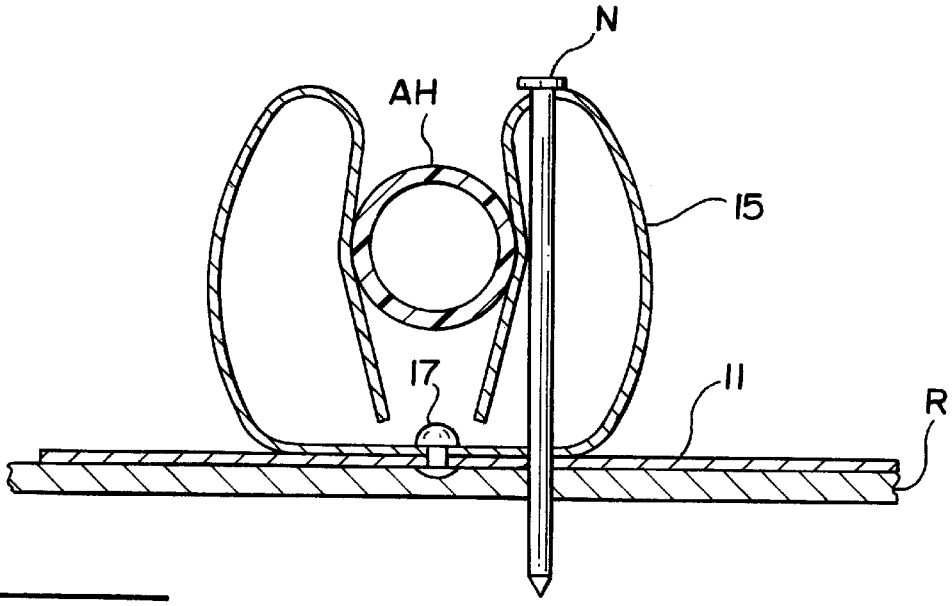
FIG. 11 is a cross-sectional view of a portion of FIG. 10 taken through line 11—11.

1. As shown in FIGS. 7 and 8, the clip bar 10 of this invention is used to support an air hose AH on a shingled pitched roof The upper portion of the clip bar 10 has been secured to the roof R by nails N,N under a shingle S, one through the aperture and another through the slot at one end of the clip bar 10 (in FIG. 7, the shingle S is shown in a raised position ). In FIG. 8, the shingle S is shown in an unraised position covering the upper portion of the clip bar 10.
2. As shown in FIG. 9, two clip bars 10, 10 of this invention are used to support an air hose AH and a water hose WH on an unshingled pitched roof R of a building B. The air hose AH may be connected via connector C to a pneumatic hammer (not shown) and the water hose WH is connected to a nozzle N. Connections at the opposite ends of the water and air hoses are not shown for simplicity.
3. As shown in FIG. 10, the clip bar 10 of this invention is supporting an electrical cord EC and an air hose AH on an unshingled pitched roof R. However, in this example, both of the U-shaped spring clips 15 and 16 are at an angle relative to the flat element 11 of the clip bar 10. Under some circumstances it may be desirable to maintain both the air hose AH and the electrical cord EC in this particular orientation. In which case, each of the off-set openings 23 and 24 (not seen in FIG. 10) in the flat element 11 is alined with its respective off-set aperture 33 and 33 in the respective bases 25 and 25 of each U-shaped spring clip 15 and 16 and an appropriately sized nail N is passed through the alined apertures (19 and 33 or 20 and 33) in each of the U-shaped spring clips 15 and 16 and through the corresponding off-set openings 23 and 24 of the flat element 11 and thence driven into the sheathing of the roof R to fix each of the U-shaped spring clips 15 and 16 in a skewed orientation. Another advantage in this particular arrangement is that the air hose AH and the electrical cord EC are each held more firmly by their respective spring clips 15 and 16 by virtue of the fact that the nail N in each of the spring clips 15 and 16 forces the adjacent gripping portion towards the center of the respective spring clip, 15 or 16. FIG. 11 is a cross-sectional view (taken along line 11—11 of FIG. 10) which clearly shows how the spring clip 15 is secured by nail N to the roof R in its skewed orientation; spring clip 16 is secured to roof R in a similar manner.

Modifications of this invention will be readily apparent to those skilled in the art and it is intended that the invention be not limited by the embodiments disclosed herein but that the scope of the invention be defined by the appended claims.

What is claimed is:

1. In combination, an unshingled pitched roof and a clip bar for supporting or stabilizing air hoses, water hoses, electrical cords, safety ropes, cables, etc., on said unshingled pitched roof, said clip bar comprising an elongated, substantially flat element having an upper surface and an opposite lower surface, at least one spring clip secured to said flat element on said upper surface, and said flat element having at least one opening therein near one end thereof wherein said at least one opening is an aperture or a slot.

2. In combination, a shingled pitched roof and a clip bar for supporting or stabilizing air hoses, water hoses, electrical cords, safety ropes, cables, etc., on said shingled pitched roof, said clip bar comprising an elongated, substantially flat element having an upper surface and an opposite lower surface, at least one spring clip secured to said flat element on said upper surface, said flat element having at least one opening therein near one end thereof wherein said at least one opening is an aperture or a slot and wherein said one end of said clip bar is secured to said shingled pitched roof beneath an overlapping portion of a shingle.

3. A clip bar for supporting, fixing or stabilizing air hoses, water hoses, electrical cords, safety ropes, cables, etc., on a pitched roof, said clip bar comprising an elongated, substantially flat element having an upper surface and an opposite lower surface, at least one spring clip secured to said flat element on said upper surface, and said flat element having at least one opening therein near one end thereof wherein said at least one opening includes both an aperture and a slot, said slot being located near said aperture offset therefrom and along an elongated side edge of said flat element.

4. A clip bar for supporting, fixing or stabilizing air hoses, water hoses, electrical cords, safety ropes, cables, etc., on a pitched roof, said clip bar comprising an elongated, substantially flat element having an upper surface and an opposite lower surface, at least one spring clip secured to said flat element on said upper surface, said at least one spring clip is U-shaped, said at least one U-shaped spring clip comprises a strip or ribbon of material, said strip or ribbon of material having a substantially flat base with two oppositely spaced arms extending therefrom, each of said arms having a reentrant portion extending towards said base and having a gripping portion near the center of said U-shaped strip or ribbon, one of said arms has a second aperture in a section thereof farthest removed from said base, said base has a third aperture therein alined with said second aperture and offset from said first aperture each of said gripping portions being in spaced opposition to each other to form a gripping mechanism for an object, said at least one U-shaped spring clip has a first aperture in the center of said flat base, said flat element has a first opening therein and said at least one U-shaped spring clip is secured to said flat element by means of a rivet passing through said first aperture and said first opening through said flat element in alinement with said first aperture and said flat element having at least one opening therein near one end of said flat element wherein said opening is an aperture or a slot.

5. A removable clip bar for supporting, fixing or stabilizing air hoses, water hoses, electrical cords, safety ropes, cables, etc., on a pitched roof, said removable clip bar comprising an elongated, substantially flat element having an upper surface and an opposite lower surface, said flat element having a longitudinal axis, at least one spring clip secured to said flat element on said upper surface, said at least one spring clip having a length alined along said longitudinal axis, said at least one spring clip having a width which is orthogonal to said longitudinal axis, said length being less than said width and said flat element having only one opening therein near one end thereof wherein said only one opening is an aperture or a slot.

6. The clip bar of claim 4 wherein said flat element has a second opening therein and said second opening is spaced adjacent said first opening but off-set therefrom.

7. The clip bar of claim 6 wherein said flat element has a third opening and a fourth opening therein, said third opening being spaced from said first opening and in alinement therewith, and said fourth opening being spaced from said third opening but off-set therefrom.

8. The clip bar of claim 5 wherein said at least one spring clip is U-shaped.

9. The clip bar of claim 5 wherein there are two spring clips secured at spaced locations on said flat element.

10. The clip bar of claim 9 wherein each of said two spring clips is U-shaped.

11. The clip bar of claim 9 wherein one spring clip is larger than the other spring clip.

12. The clip bar of claim 9 wherein each of said spring clips is rotatable about its axis.

13. The clip bar of claim 12 wherein each of said spring clips is secured to said flat element by a rivet.

14. The clip bar of claim 5 wherein said flat element has a raised edge extending above said upper surface at the opposite end said flat element.

15. The clip bar of claim 8 wherein said at least one U-shaped spring clip comprises a strip or ribbon of material, said strip or ribbon of material having a substantially flat base with two oppositely spaced arms extending therefrom, each of said arms having a reentrant portion extending towards said base and having a gripping portion near the center of said U-shaped strip or ribbon, each of said gripping portions being in spaced opposition to each other to form a gripping mechanism for an object.

16. The clip bar of claim 15 wherein said at least one U-shaped spring clip has a first aperture in the center of said flat base.

17. The clip bar of claim 16 wherein said flat element has a first opening therein and said at least one U-shaped spring clip is secured to said flat element by means of a rivet passing through said first aperture and said first opening through said flat element in alinement with said first aperture.

18. The clip bar of claim 17 wherein one of said arms has a second aperture in a section thereof farthest removed from said base and said base has a third aperture therein alined with said second aperture and offset from said first aperture.

19. The clip bar of claim 18 wherein said flat element has a second opening therein and said second opening is spaced adjacent said first opening but off-set therefrom.

20. The clip bar of claim 19 wherein said flat element has a third opening and a fourth opening therein, said third opening being spaced from said first opening and in alinement therewith, and said fourth opening being spaced from said third opening but off-set therefrom.

* * * * *